United States Patent [19]

Williams

[11] Patent Number: 5,046,705

[45] Date of Patent: Sep. 10, 1991

[54] WEDGE FOR MOUNTING FENCE POST COLLARS

[75] Inventor: Jeffery D. Williams, Tumacacori, Ariz.

[73] Assignee: Wedge-Loc Co., Inc., Rio Rico, Ariz.

[21] Appl. No.: 576,070

[22] Filed: Aug. 31, 1990

[51] Int. Cl.[5] ..... E04H 12/22

[52] U.S. Cl. ..... 256/36; 256/56; 256/70

[58] Field of Search ..... 256/64, 65, 68, 70, 256/35, 36

[56] References Cited

U.S. PATENT DOCUMENTS 1,330,808 2/1920 James .
3,670,468 6/1972 Cordell .
3,820,758 6/1974 Berg .
3,874,640 4/1975 Wagner .
4,077,611 3/1978 Wilson .
4,286,897 9/1981 Suskind .
4,763,879 8/1988 Wasicek .
4,889,322 12/1989 Wagner .

FOREIGN PATENT DOCUMENTS 598417 2/1948 United Kingdom .

*Primary Examiner*—Andrew V. Kundrat
*Attorney, Agent, or Firm*—LaValle D. Ptak

[57] ABSTRACT

A hollow T-shaped wedge member is used for attaching a rectangular collar to a T-post fence post for utilization in conjunction with a bracing system for fences made from such T-posts. The wedge member is shaped to straddle the rear leg of the T-post to produce a wedging engagement between the rear of the front face of the post and the inside of a collar placed over the post. The wedge tightly holds the collar wedged onto the T-post, and aligned with it, and includes a provision for inhibiting withdrawal of the wedge once it is in place.

17 Claims, 1 Drawing Sheet

WEDGE FOR MOUNTING FENCE POST COLLARS

RELATED APPLICATION AND PATENT

This application is related to the co-pending application Ser. No. 07/413,285 filed Sept. 27, 1989 now U.S. Pat. No. 4,979,724, and to U.S. Pat. No. 4,889,322 issued Dec. 26, 1989, both assigned to the same assignee as the present application.

BACKGROUND

Fence posts are widely used in the construction of fences for a variety of purposes, such as animal management, property boundaries, snow barriers and the like. A popular type of fence post is made of steel and has a T-shaped cross section or a Y-shaped cross section. In the United States, these posts are commonly called "T-posts." The flat, vertical face has a spaced series of lugs or projections extending in a line opposite the rear or "leg" portion of the T-cross section. These lugs then are used to facilitate the attachment of wire (usually barbed wire), which is stretched along the posts and secured at intervals to braced line posts and corner posts. Bracing for the line posts and corner posts must be solid if the fence wire is to maintain its tension over a period of time.

The shape of metal T-posts or Y-posts does not facilitate simple attachment of braces with common hardware. Usually, the posts in a fence system which require braces are made of angle iron. Bracing of such posts is slow and cumbersome, since normally an angle iron brace is secured to the angle iron post with makeshift hardware. Frequently, a hole must be drilled through the post to secure the brace. Since fences of this type frequently located substantial distances from household power sources, portable generators or battery operated tools are necessary. Conventional bracing also typically secures the opposite or lower end of the brace in the soil, either with driven stakes or poured concrete. It is readily apparent that the bracing of T-posts or Y-posts in this manner is inefficient and costly.

Devices have been developed for attachment to a T-post, which clip onto the post through a type of spring action, or which are secured to the posts by means of threaded fasteners. Two patents disclosing devices for permitting the subsequent mounting of electric fence wire on metal T-posts are U.S. Pat. Nos. 3,820,758 (Berg) and 4,077,611 (Wilson). Both of these patents disclose a clip-on member made of insulating material which snaps over the post and is held in place by friction. Since the devices of both of these patents include a portion which rests on the post between the positioning lugs, vertical movement of the mounting device is restricted by the lugs located above and below the device.

The U.S. Pat. No. 3,874,640 (Wagner) discloses an attachment for placement on a T-post, between adjacent lugs, which facilitates the handling or tensioning of barbed wire, so that the wire may be stretched first and then raised out of the device and attached to the fence post. This is a temporary guide which is secured to the post only during the time the wire tensioning operation is effected.

The U.S. Pat. No. 3,670,468 (Cordell) is directed to a wedge for removably securing and aligning a T-post inside a larger pipe, for use in temporary fencing. The T-post loosely fits within the pipe; and the wedge then holds it in place vertically within the pipe, until removal of the wedge permits subsequent removal of the post. A substantial length of the post, including the positioning lugs on the front, is enclosed within the pipe at the bottom end of the post.

In U.S. Pat. No. 4,763,879 (Wasicek), a removable collar, which has a brace member welded to it, is placed over a T-post. The collar is of cylindrical shape and has an aperture in it for receiving a projection on the T-post when the collar is placed in the desired vertical position on the post. A wedge then is utilized to removably secure the collar to the post. Because the collar is cylindrical, the wedge makes contact with the collar in only two spaced-apart locations when it is driven between the collar and the post. In addition, because a single wedge is used, there is a tendency for the collar to tip or tilt on the post.

The U.S. Pat. No. 4,286,897 (Susskind) is similar in some respects to the device shown in the Wasicek patent. In the apparatus disclosed in Susskind, a clamp apparatus is used to secure a collar onto a cylindrical post. The clamp is a two-point or clamp or wedge which enters the collar from both the top and bottom, and further includes a bolt for drawing the two parts of the clamp toward one another to wedge the collar onto the post. The device of Susskind requires a number of different parts, but the tendency for the collar to tip which is present in Wasicek is overcome by the Susskind device.

The above identified U.S. Pat. No. 4,889,322 (Wagner) is an improvement over the devices shown in the Wasicek and Susskind patents. A collar having a rectangular internal configuration is placed between adjacent lugs on a T-post, and a wedge is driven between the rear of the T-post and the collar, to hold it in place. Because of the rectangular internal configuration, the wedge makes a substantial contact with the internal surface of the collar to firmly and securely hold the collar in place on the post. The wedge contacts the post at two points on the edge of the rear leg of the post. There still is a slight tendency for the collar to tip or tilt somewhat, because of the manner in which the wedge applies pressure between the post and a region of the collar located primarily along its upper edge.

The U.S. Pat. No. 1,330,808 (James) discloses a different type of fence post clamp for use on a cylindrical pipe fence post. The James fence post clamp has a generally cylindrical cross section which is open at one end, for clamping around a fence post. The clamp is held in place by pressure applied through the open edge. This open edge also includes a slot in it, and the end of a cross brace is inserted into the slot. The cross brace has a hole through it, as does the extension on the clamp. A bolt then is placed through the holes in the clamp and the end of the cross brace to secure the clamp onto the fence post and to secure the cross brace to the clamp. This device is not intended for use with a T-post or Y-post type of fence.

Another type of slide-on collar for use in a bracing system for fence posts is disclosed in the British patent to Holmes No. 598,417. This patent is directed to a bracing system for use with wooden fence posts having a rectangular cross section. A metal collar has an internal configuration permitting it to be slidably located at different vertical locations on the fence post. Once the desired location is determined, the collar is secured in place by a wood screw or other suitable fastener extending through an aperture in the collar into the post. The collar of Holmes clearly is not suitable for use with a T-post or Y-post fence system.

The above identified co-pending application is an improved double-action expansion wedge for mounting a collar of the type disclosed in U.S. Pat. No. 4,889,322 (Wagner). The collar member of the co-pending application, Ser. No. 07/413,285 now U.S. Pat. No. 4,979,724, wedges between the rear edge of the rear leg of the T-post and the inside of the collar member in a manner similar to that of U.S. Pat. No. 4,889,322 (Wagner), but because of the double action expansion cam construction, the tendency for the collar member to tilt is minimized. The wedge disclosed in this patent, however, is a two-piece wedge.

It is desirable to provide an improved attachment mechanism for mounting a collar on T-posts used in a fence system, and for overcoming the disadvantages of the prior art.

SUMMARY OF THE INVENTION

It is an object of this invention to provide an improved wedge member for releaseably securing a mounting collar to a fence post.

It is an additional object of this invention to provide an improved wedge and collar hardware system for use in T-post bracing systems.

It is another object of this invention to provide an improved single-piece wedge member for use with a mounting collar, to attach the mounting collar to a fence T-post.

In a preferred embodiment of the invention, a mounting wedge is provided for attaching a hollow rectangular collar member to a fence T-post. The collar has a top edge and a bottom edge, and the internal cross section of the collar is dimensioned to permit it to slidably fit over a fence T-post, with a space between the interior of the collar and the T-post. A wedge member is shaped to straddle the rear leg of the T-post, for wedging engagement between the rear of the front face of the post and the inside of the collar member when the wedge is driven downwardly into the space between the collar and the T-post. The collar member then is held in place on the T-post by the action of the wedge.

DETAILED DESCRIPTION

Figures 1, 2A, 2B, 2C, 2D, 3, 4A, 4B, 5:
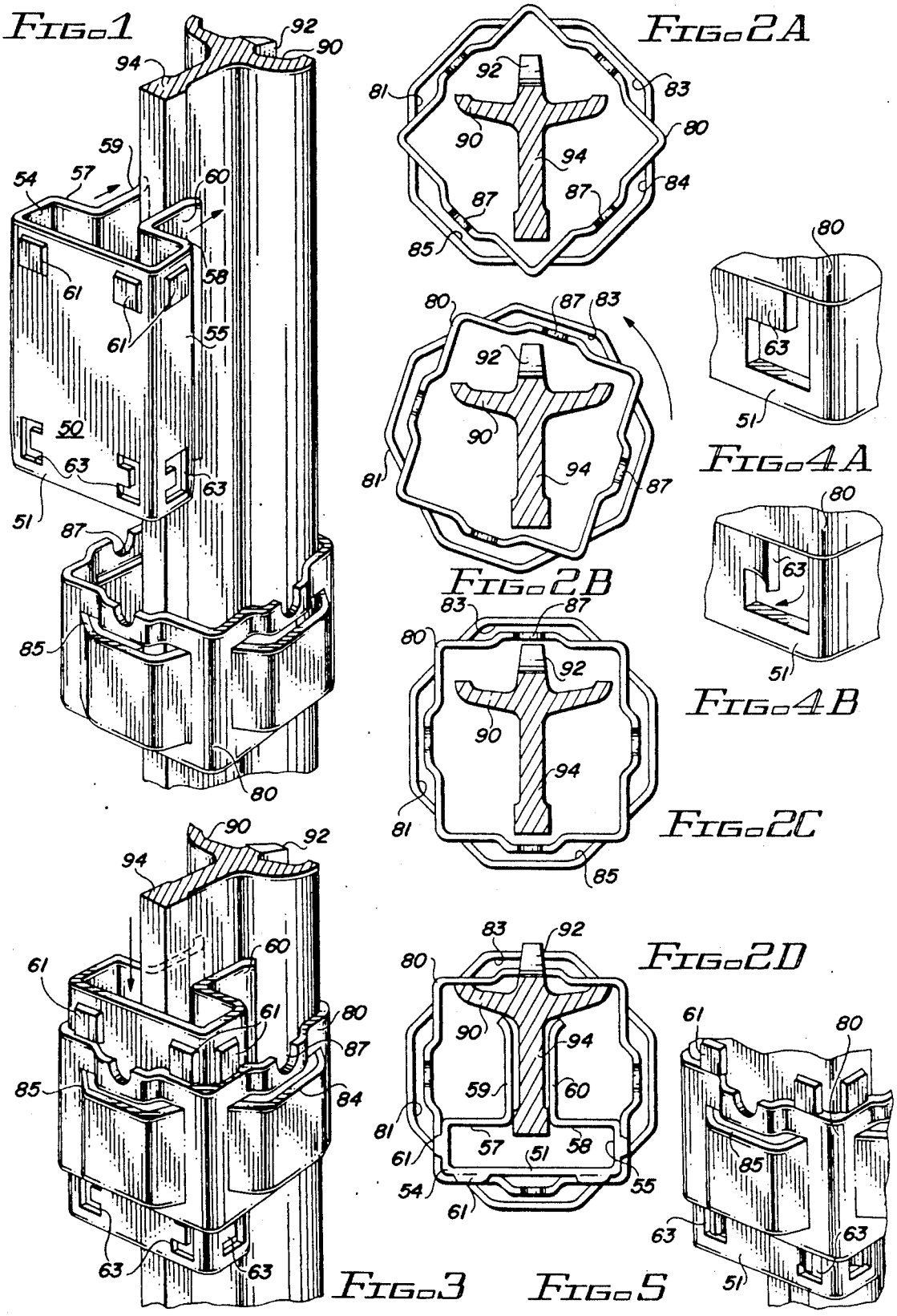
FIG. 1 is a partially exploded perspective view of a preferred embodiment of the invention.
FIGS. 2A through 2D are top views illustrating the manner of installation of the device of FIG. 1 on a conventional T-post.
FIG. 3 is an assembled perspective view of the embodiment shown in FIG. 1.
FIGS. 4A and 4B illustrate details of the embodiment shown in FIGS. 1 and 2.
FIG. 5 illustrates a detail of the embodiment shown in FIG. 3.

In the description of the preferred embodiment, reference is made to a fence T-post. This term as used herein is to be understood to apply as well to a similar type of post, used in some areas of the world, known as a Y-post. Both of these posts are steel posts used for fencing purposes, but the cross-sectional configuration approximates a "T" or a "Y" in appearance.

Reference now should be made to the drawing in which the same reference numbers are used throughout the different figures to designate the same components. The collar 80 and the wedge 50 for locking the collar onto the T-post are used for the purposes described in greater detail in the above identified related patent and co-pending application. Since the post bracing system is clearly disclosed in U.S. Pat. No. 4,889,322, no further description of that system as such is considered necessary here.

Reference now should be made to FIGS. 1 and 2, which illustrate the details of the manner of attachment of the mounting collar 80 onto a fence T-post which has a rear leg 94, with a slightly curved front face 90, from which spaced lugs 92 project. The collar 80 has a substantially rectangular (preferably square) internal cross section and is made with a vertical dimension chosen to fit between adjacent lugs 92 on the front of a T-post. Each of the four sides of the collar 80 is punched out to form tongue receiving projection pockets 81, 83, 84 and 85, extending longitudinally and outwardly from the central portion of each of the four surfaces of the collar 80, as shown most clearly in FIGS. 1, 2 and 3. Cut-outs or depressions 87 are located in the center of both the top and bottom edges of all sides of the mounting collar 80, and align with the lugs 92 on the front of the T-post when the collar is in place between the lugs. These depressions 87 assist in aligning the collar with the lugs whenever the collar is moved upwardly or downwardly to engage the corresponding lug 92 on the face of the T-post.

FIG. 1 shows a T-post 90/94 with a collar 80 in place at a point intermediate its length, and located between two adjacent lugs 92 on the front of the post. To attach the collar 80 between adjacent spaced lugs 92 on the T-post 90/94, a camming wedge 50 is used. The wedge 50 is illustrated in position in FIG. 1 just prior to utilization to assemble the collar 80 onto the T-post 92/94. As is apparent from an examination of FIG. 1, the wedge 50 has a generally hollow T-shaped configuration, with a front face 51 for engaging the internal surface of the collar 80 which is located opposite the edge of the rear leg 94 of the T-post. A pair of sides 54 and 55, extend perpendicularly to the surface 51 and fit in the collar adjacent the internal surfaces of the collar 80 on opposite sides of the T-post. These sides then fold inwardly a short distance 57 and 58, respectively, to form a space slightly wider than the width of the rear leg 94 of the T-post. Extending toward the T-post from this space, are a pair of legs 59 and 60, which straddle the sides of the rear leg 94 of the T-post. These legs 59 and 60 are flared outwardly slightly to facilitate installation of the wedge 50 over the rear leg 94 of the T-post by pressing it in the direction of the arrows shown in FIG. 1. This is done until the legs 59 and 60 abut the rear side of the front face 90 of the T-post, as shown in FIG. 3.

Once the wedge 50 is placed over the rear leg 94 of the T-post with the legs 59 and 60 resting against the rear surface of the front face 90 of the T-post, the wedge 50 is driven downwardly by a hammer or other suitable tool, as shown in FIG. 3, to the position illustrated in FIG. 3. To accomplish this, at least the bottom edges of the face 51 and the sides 54 and 55 are tapered inwardly slightly to permit the wedge 50 to fit in the space between the collar 80 and the T-post, as illustrated in FIG. 1.

The maximum downward travel of the wedge 50 is limited by projections 61 located on the surfaces 51, 54 and 55, to cause these projections to rest on the top edge of the collar 80 when the wedge 50 is driven to the position shown in FIG. 3. The wedge is made of sheet metal, such as steel or aluminum, and is dimensioned to tightly fit between the T-post and the inside of the collar through a camming action between the edges of the legs 59 and 60 pressing against the rear of the front face 90 of the T-post and the inside of the collar 80.

Even if, however, the wedge 50 does not tightly engage the collar, the projections 92 on the front of the T-post extend far enough beyond the upper edge of the collar 80 that the vertical movement of the collar 80 is limited to the distance between two adjacent lugs 92 on the front of the T-post, and the corresponding distance between two of the notches 87 on the top and the bottom edges of the side of the collar 80 which is placed between the lugs 92.

FIGS. 2A through 2D illustrate the manner in which the collar 80 is placed on a T-post 90/94; and, subsequently, securely held in place by the wedge member 50, shown in FIGS. 1 and 3. In FIG. 2A, the collar 80 is shown in position to be moved downwardly over the top of a T-post after the T-post has been driven into the ground. The distance between opposite internal walls of the opening of the collar 80 is selected to be slightly greater than the overall front-to-back distance of the T-post between the rear surface of the leg 94 to the outermost projection of the lugs 92. The face 90 of a conventional T-post typically is not as wide as its front-to-back dimension. Consequently, the collar 80 readily may be slipped into place and moved to any desired vertical location on the T-post, as shown in FIG. 2A. Generally, this location of the collar is achieved by orienting the collar on the diagonal with respect to the leg 94 and the projections 92, since this provides the greatest clearance to facilitate placement of the collar on the T-post. When the desired location is found, the collar 80 is rotated approximately 45° (either counterclockwise or clockwise as shown in FIGS. 2B and 2C) to provide the orientation illustrated. Then the collar 80 is pushed toward the front surface of the front face 90, to cause the inside wall of the opening in the collar 80 which faces that surface to engage the front face 90 between a pair of adjacent lugs 92. This is shown most clearly in FIG. 2D.

To hold the collar 80 in place on the post, the wedge member 50 is first placed in position in the space between the rear edge of the leg 94 and the internal surface of the collar 80, with the legs 59 and 60 straddling opposite sides of the leg 94, as shown most clearly in FIG. 2D. The wedge member 50 then is driven downwardly by applying force, such as with a hammer, on the upper surface of the wedge 50, to wedge it into place as shown in cross-sectional view in FIG. 2D, and as illustrated in perspective view of FIG. 3. It can be seen that the pressure between the inside of the collar and the front edges of the legs 59 and 60 causes the collar 80 to be firmly held in place between a pair of upper and lower lugs 92 on the T-post 90/94.

After the collar 80 has been driven in place to the position shown in FIG. 3, four tabs 63, which are formed in cut-outs near the lower edge of the collar, are bent outwardly as shown most clearly in FIGS. 4A and 4B to the position shown in FIG. 5 to prevent accidental dislodgement of the wedge 50 from the collar. If subsequent removal of the wedge 50 from the collar is desired, the tabs 63 simply may be pounded inwardly to the position shown in FIG. 4A, and the wedge 50 may be driven upwardly from the bottom to remove it.

The foregoing description of a preferred embodiment of the invention is to be considered as illustrative only. Various changes and modifications will occur to those skilled in the art without departing from the true scope of the invention as defined in the appended claims.

I claim:

1. A mounting wedge for attaching a collar to a fence T-post where the T-post has a rear leg extending from substantially the center of a front face, and where the collar is a hollow collar member, having a predetermined length with a top edge and a bottom edge, and with a substantially rectangular internal cross-section dimensioned in at least the diagonal thereof, to permit said collar member to slideably fit over a fence T-post, with a space between the interior of said collar member and such fence T-post, said wedge comprising:

a wedge member shaped to straddle the rear leg of said T-post for wedging engagement between the rear of the front face of said post and the inside of said collar member adjacent the edge of the rear leg of said T-post, to hold said collar member wedged onto said fence T-post, and aligned therewith, said wedge member having a substantially uniform cross-section throughout the length thereof, in the form of a hollow "T" shape, with a pair of legs thereon for straddling the rear leg of said T-post.

2. A mounting wedge according to claim 1 wherein said wedge member is tapered to facilitate insertion thereof into said hollow collar member.

3. A mounting wedge according to claim 2 wherein the legs of the "T" of said wedge member terminate in an outwardly curved portion, extending away from the rear leg of said T-post when said wedge member straddles such rear leg of said T-post.

4. A mounting wedge according to claim 3 wherein said wedge member has a length greater than the predetermined length of said collar member, with limit means for limiting the distance said wedge member can extend into said collar member.

5. A mounting wedge according to claim 4 wherein said wedge member has an upper edge and a lower edge, and said limit means are located adjacent the upper edge thereof, so that with said wedge member fully inserted into said collar member to the limit established by the said limit means, the lower end of said wedge member extends beyond the bottom edge of said hollow collar member.

6. A mounting wedge according to claim 5 further including locking means located adjacent the lower edge of said wedge member for preventing the withdrawal of said wedge member from said collar member.

7. A mounting wedge according to claim 6 wherein said locking means comprises a bendable tab.

8. A mounting wedge according to claim 7 wherein said limit means comprises at least one protrusion extending outwardly from the surface of said wedge member near the upper edge thereof.

9. A mounting wedge according to claim 1 wherein said wedge member has a length greater than the predetermined length of said collar member, with limit means for limiting the distance said wedge member can extend into said collar member.

10. A mounting wedge according to claim 9 wherein said wedge member has an upper edge and a lower edge, and said limit means are located adjacent the upper edge thereof, so that with said wedge member fully inserted into said collar member to the limit established by the said limit means, the lower end of said wedge member extends beyond the bottom edge of said hollow collar member.

11. A mounting wedge according to claim 9 wherein said limit means comprises at least one protrusion extending outwardly from the surface of said wedge member near the upper edge thereof.

12. A mounting wedge according to claim 9 further including locking means located adjacent the lower edge of said wedge member for preventing the withdrawal of said wedge member from said collar member.

13. A mounting wedge for attaching a collar to a fence T-post where the T-post has a rear leg extending from substantially the center of a front face, and where the collar is a hollow collar member, having a predetermined length with a top edge and a bottom edge, and with a substantially rectangular internal cross-section dimensioned in at least the diagonal thereof, to permit said collar member to slideably fit over a fence T-post, with a space between the interior of said collar member and such fence T-post, said wedge comprising:

a wedge member having a length greater than the predetermined length of said collar member and shaped to straddle the rear leg of said T-post for wedging engagement between the rear of the front face of said post and the inside of said collar member adjacent the edge of the rear leg of said T-post, to hold said collar member wedged onto said fence T-post, and aligned therewith; said wedge member having limit means for limiting the distance said wedge member having limit means for limiting the distance said wedge member can extend into said collar member; and locking means located adjacent the lower edge of said wedge member for preventing the withdrawal of said wedge member from said collar member.

14. A mounting wedge according to claim 13 wherein said locking means comprises a bendable tab.

15. A mounting wedge according to claim 14 wherein said limit means comprises at least one protrusion extending outwardly from the surface of said wedge member near the upper edge thereof.

16. A mounting wedge according to claim 1 wherein said wedge member has a substantially uniform cross-section throughout the length thereof, in the form of a hollow "T" shape, with a pair of legs thereon for straddling the rear leg of said T-post.

17. A mounting wedge according to claim 16 wherein the legs of the "T" of said wedge member terminate in an outwardly curved portion, extending away from the rear leg of said T-post when said wedge member straddles such rear leg of said T-post.

* * * * *